US010292251B2

(12) United States Patent
Kikuchi et al.

(10) Patent No.: US 10,292,251 B2
(45) Date of Patent: May 14, 2019

(54) X-RAY INSPECTION DEVICE

(71) Applicant: ANRITSU INFIVIS CO., LTD., Atsugi-shi, Kanagawa-ken (JP)

(72) Inventors: Toshiaki Kikuchi, Atsugi (JP); Naoya Saito, Atsugi (JP); Hisashi Hayashi, Atsugi (JP); Takashi Kanai, Atsugi (JP)

(73) Assignee: ANRITSU INFIVIS CO., LTD., Atsugi-Shi, Kanagawa-Ken (JP)

( * ) Notice: Subject to any disclaimer, the term of this patent is extended or adjusted under 35 U.S.C. 154(b) by 80 days.

(21) Appl. No.: 15/287,240

(22) Filed: Oct. 6, 2016

(65) Prior Publication Data

US 2017/0171953 A1 Jun. 15, 2017

Related U.S. Application Data

(60) Provisional application No. 62/266,974, filed on Dec. 14, 2015.

(51) Int. Cl.
*H05G 1/02* (2006.01)

(52) U.S. Cl.
CPC ..... *H05G 1/025* (2013.01)

(58) Field of Classification Search
None
See application file for complete search history.

(56) References Cited

U.S. PATENT DOCUMENTS 5,982,843 A 11/1999 Bailey et al.
2009/0279660 A1* 11/2009 Takamatsu ..... A61B 6/035 378/19
2010/0177863 A1* 7/2010 Jimbo ..... A61B 6/035 378/15
2015/0260417 A1* 9/2015 Kawata ..... F24F 7/10 165/57

FOREIGN PATENT DOCUMENTS

JP 2007-292497 A 11/2007
JP 2013-088199 A 5/2013
JP 5364302 B2 12/2013

OTHER PUBLICATIONS

Japan Patent Office, "Office Action for Japanese Patent Application No. 2014-245129," dated Aug. 7, 2018.

* cited by examiner

*Primary Examiner* — Hoon K Song
(74) *Attorney, Agent, or Firm* — Manabu Kanesaka

(57) ABSTRACT

An X-ray inspection device achieves a high cooling effect without using an expensive air conditioner and is excellent in cleaning property. The inside of a first case of an X-ray inspection device is separated into plural cooling partitions by separation walls by the use limit temperature and the like, and heat sources respectively having intrinsic use limit temperature are stored in respective partitions. Because a flow passage of air is set inside the cooling partition so that the heat sources having low use limit temperature are disposed upstream of the heat sources having high use limit temperature, the cooling efficiency is excellent. A heat absorption member of a heat exchange device exists inside the first case, and a heat radiation member exists inside a second case communicating with the external air. Because there is no protrusion of the heat radiation member as the total cases, cleaning property is excellent.

7 Claims, 3 Drawing Sheets

X-RAY INSPECTION DEVICE

RELATED APPLICATIONS

This application claims the benefit of U.S. Provisional Application No. 62/266,974, filed on Dec. 14, 2015, the contents of which are incorporated herein by reference.

TECHNICAL FIELD

The present invention relates to an X-ray inspection device that irradiates X-rays to an object to be inspected, detects the X-rays having transmitted the same and thereby inspects the same, and relates specifically to an X-ray inspection device that can cool heat sources inside cases by a heat exchange device and is excellent also in cleaning property of the outer surface of the case.

BACKGROUND ART

In Japanese Patent No. 5364302, as a prior art of an invention related to the patent application, an X-ray foreign object detection device including an industrial use air conditioner is described in the paragraph of the background art. As shown in FIG. 14 of the literature, an air conditioner 102 is protrudingly attached to the outer surface on the back face side of a case 101 of the X-ray foreign object detection device 100. With respect to a casing 104 that forms the outer shape of this air conditioner 102, its inside is separated by a separation wall 103, one side communicates with the case 101 of the X-ray foreign object detection device 100, and the other side communicates with the external air. Also, it is configured that a radiator 105 is arranged in the separation wall 103 inside the casing 104. Further, the inside of the casing 104 and the inside of the case 101 that communicates therewith are cooled by the arrangement that the heat inside is exchanged with the external air and is transferred and discharged by the radiator 105.

SUMMARY OF INVENTION

Technical Problem

An X-ray inspection device for industrial use has been widely used which irradiates X-rays to an object to be inspected, detects the X-rays having transmitted the same, and thereby inspects the same. With respect to the X-ray inspection device, an electric supply and the like which is a heat source is stored inside a case which is a main body and the X-ray inspection device generates due amount of heat at the time of use, and therefore one with an air-cooled structure is known in which a filter is arranged at an opening formed in the case with the aim of cooling the inside of the case, and the external air is taken in to the inside of the case by air blow means such as a fan.

However, in such X-ray inspection device for industrial use, in the case the food and the like for example is made the object to be inspected, the dust and the moisture such as the water drops generated from the food and the like are present much in the environment of the inspection line where the device is installed, therefore the air including them passes through the filter arranged in the opening of the case, and thereby there is a case the internal board such as the control board and the power supply board is corroded or short-circuited which results in detriment of the function of the X-ray inspection device.

In order to eliminate such defect of the air-cooled structure caused by suction of the external air and to obtain a secure cooling effect, there is a case of using an X-ray foreign object inspection device externally attaching an industrial air conditioner on the outer surface of the case as explained previously referring to Japanese Patent No. 5364302. However, because such air conditioner is not merely a heat exchange device but a device including a compressor and driven by electric power, there is a problem that the cost of itself is high, the cost of the total X-ray foreign object inspection device therefore becomes high, and the running cost increases. Also, because of the structure of being externally attached to the outer surface of the case of the X-ray foreign object inspection device, the outline dimension of the total X-ray foreign object inspection device becomes large, and such case is possible that the complicated outer shape becomes a disturbance of cleaning in cleaning frequently required when a food and the like is made an object to be inspected and a problem occurs in the sanitary property.

The present invention has been achieved in view of the problems in the prior art described above, and aims to provide an X-ray inspection device including cooling means achieving high cooling effect and having sufficient cleaning property without using an air conditioner whose equipment cost and running cost are high.

Solution to Problem

The X-ray inspection device according to a first aspect of the invention is an X-ray inspection device that inspects an object to be inspected by detecting X-rays irradiated to and transmitted through the object to be inspected, comprising a first case that stores a plurality of heat sources inside and is closed against an environmental atmosphere, a second case that is attached to the first case and is opened to the environmental atmosphere, and a heat exchange device for cooling the heat sources, the heat exchange device including a hermetically closed case and a heat exchange medium, the case having a heat absorption member disposed inside the first case and a heat radiation member disposed inside the second case, the heat exchange medium being sealed inside the case and conducting heat from the heat absorption member to the heat radiation member without being imparted with work from the outside.

The X-ray inspection device according to a second aspect of the invention is the X-ray inspection device according to the first aspect in which a flow passage for cooling the heat sources by making air circulate in a predetermined order is formed inside the first case.

The X-ray inspection device according to a third aspect of the invention is the X-ray inspection device according to the second aspect in which plural cooling partitions which are separated based on use limit temperature of the heat sources and in which the heat sources of the use limit temperature are stored are arranged inside the first case, and the flow passage is set inside the cooling partitions so that the heat sources the use limit temperature of which is low are disposed upstream of the heat sources the use limit temperature of which is high.

The X-ray inspection device according to a fourth aspect of the invention is the X-ray inspection device according to any one of the first to third aspects in which, inside the first case, an X-ray generating device is disposed at the center part of the first case, an LCD and a control unit as the heat source are disposed on the front face side of the first case, electric supply units as the heat source are disposed on the side face side of the first case, and the heat absorption member of the heat exchange device is disposed on the back face side of the first case, inside the second case, the heat radiation member of the heat exchange device is disposed on the back face side of the second case, and the heat radiation member opposes an exhaust port formed on the back face side of the second case.

The X-ray inspection device according to a fifth aspect of the invention is the X-ray inspection device according to the fourth aspect in which an interference prevention plate in which air introduced to the heat absorption member along the flow passage after cooling the control unit collides on one surface and air introduced to the heat absorption member along the flow passage after cooling the electric supply unit collides on the other surface is arranged inside the first case.

Advantageous Effects of Invention

According to the X-ray inspection device described in the first aspect, as cooling means inside the case, not an air conditioner requiring energy but a heat exchange device having a simple structure is used. Therefore, the cost is low, and the running cost is also low. Further, at the time of using the X-ray inspection device, the heat generated from the heat sources inside the first case is absorbed by the heat absorption member of the heat exchange device inside the first case, is radiated from the heat radiation member of the heat exchange device arranged inside the second case, and is discharged to the environmental atmosphere through the air inside the second case. Thus, the heat exchange device in the present invention is arranged so as to penetrate the wall body of the first case which stores the heat sources, and has therefore a structure protruding from the outer surface of the first case. However, because the heat radiation member of the heat exchange device protruding from the outer surface of the first case is arranged integrally with the first case and is stored in the second case that is opened to the environmental atmosphere, particular unevenness is not generated in the outer shape as the total of the first and second cases. Therefore, the cases of the X-ray inspection device are easy in cleaning and are excellent in the sanitary property.

According to the X-ray inspection device described in the second aspect, because the flow passage that makes the air circulate in a predetermined order is formed inside the first case, the air for cooling can be securely supplied to the heat sources inside the first case. Also, even when the heat source exists in plural numbers, the air flowing along the flow passage reaches respective heat sources successively, and respective heat sources can be cooled securely.

According to the X-ray inspection device described in the third aspect, with respect to the plural heat sources existing inside the first case, as an index showing the heat resistant performance or the upper limit of the usable environmental temperature, intrinsic use limit temperature is determined respectively. Also, the inside of the first case is separated into plural cooling partitions having different use limit temperature, and, in each cooling partition, the heat source having the use limit temperature corresponding to the cooling partition is stored. Further, the flow passage of the air is set so that the heat source having low use limit temperature is disposed upstream of the heat source having high use limit temperature in order that the air flows to the heat source having high use limit temperature and cools the same after cooling the heat source having low use limit temperature, or in order that the air which has cooled the heat source having high use limit temperature and of which temperature has risen does not flow through the heat source having low use limit temperature. Therefore, because the air flowing through the flow passage passes and circulates from the heat source having low use limit temperature toward the heat source having high use limit temperature while cooling the heat sources having predetermined use limit temperature for respective cooling partitions or passes and circulates through the heat source having low use limit temperature before the heat source having high use limit temperature, each heat source can be securely cooled in each cooling partition.

According to the X-ray inspection device described in the fourth aspect, the heat generated respectively by the control unit and the electric supply unit disposed at respective positions inside the first case can be absorbed by the heat absorption member of the heat exchange device disposed on the back face side inside the first case, can be radiated from the heat radiation member of the heat exchange device disposed on the back face side inside the second case, and can be discharged outside through the exhaust port arranged on the back face side inside the second case.

According to the X-ray inspection device described in the fifth aspect, inside the first case, the air having cooled the control unit is introduced to the heat absorption member along the flow passage, and collides on one surface of the interference prevention plate to change the direction. Also, the air having cooled the electric supply unit is introduced to the heat absorption member along the flow passage, and collides on the other surface of the interference prevention plate to change the direction. Thus, because these two air flows collide on the front face and the back face of the interference prevention plate respectively, there is no possibility of colliding on each other in the partition where the heat absorption member is disposed. Therefore, it is possible to lead these two air flows smoothly to the heat absorption member of the heat exchange device without making them interfere with each other, and to effect efficient heat absorption.

DESCRIPTION OF EMBODIMENTS

The first embodiment of the present invention will be described referring to FIG. 1-FIG. 3.

Figure 1:
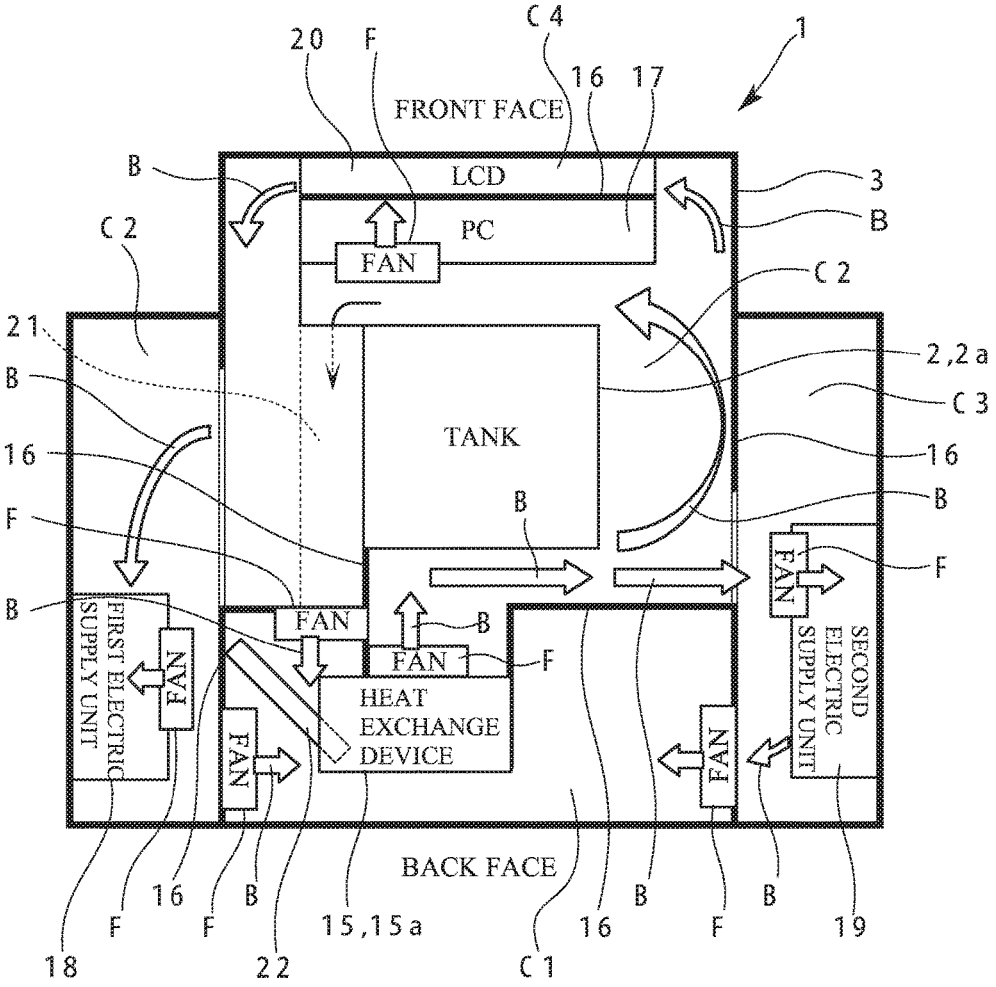
FIG. 1 is a transverse cross-sectional view in the first case of the X-ray inspection device of the present embodiment.
Figure 2:
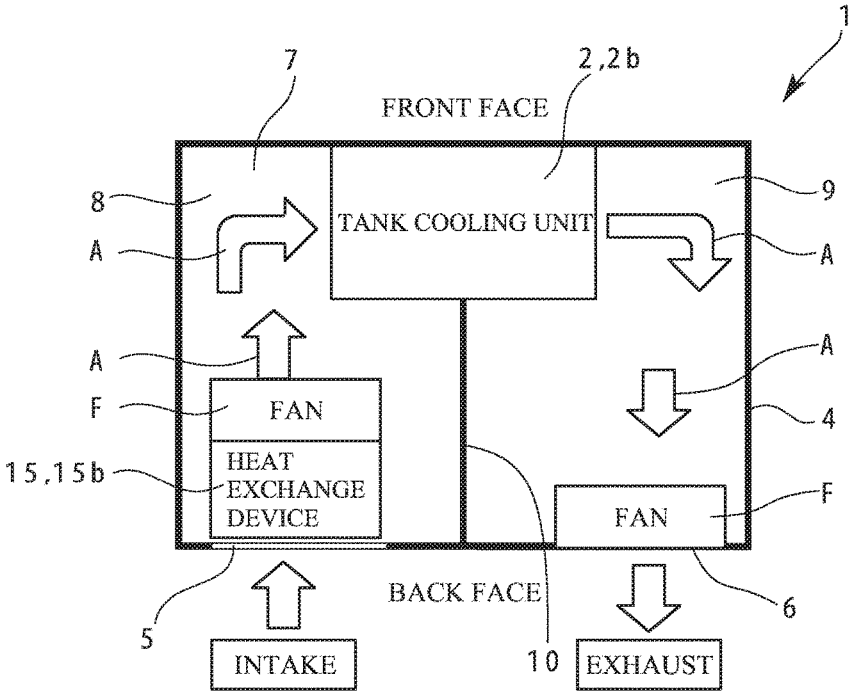
FIG. 2 is a transverse cross-sectional view in the second case of the X-ray inspection device of the present embodiment.
Figure 3:
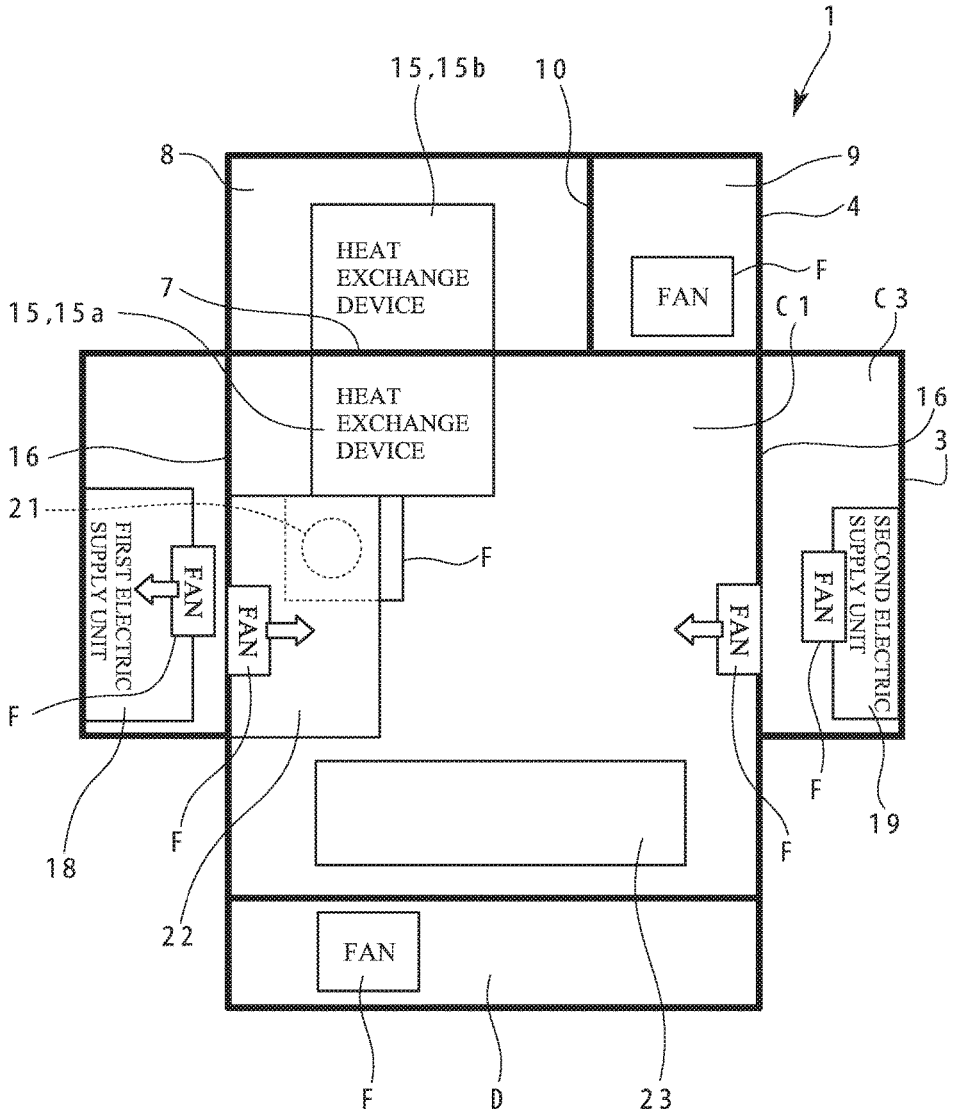
FIG. 3 is a vertical cross-sectional view of the X-ray inspection device of the present embodiment.

An X-ray inspection device 1 of the present embodiment shown in FIG. 1 to FIG. 3 is a device that irradiates X-rays from an X-ray generation device to an object to be inspected transported by transportation means, detects the X-rays having transmitted through the object to be inspected by a sensor, and thereby inspects the object to be inspected. Further, in FIG. 1 and FIG. 2, although an X-ray generation device 2 generating X-rays is shown as a tank 2*a* and a tank cooling unit 2*b*, the object to be inspected, transportation means for transporting the object to be inspected, and a sensor for detecting the X-rays having transmitted through the object to be inspected are not illustrated.

As the body frame of the device, the X-ray inspection device 1 of the present embodiment includes a first case 3 and a second case 4 integrally attached onto the first case 3 as shown in FIG. 1 to FIG. 3. Although the first case 3 is closed against the environmental atmosphere (outer field) to the degree the air dos not circulate directly between the environmental atmosphere, it is configured to be capable of approaching the internal structure for cleaning, maintenance, repair, and the like by opening a lid and the like which is not illustrated. Further, although the second case 4 does not communicate with the first case 3 and the air does not circulate between the first case 3, the second case 4 is opened to the environmental atmosphere through an intake port 5 and an exhaust port 6 arranged in the back face.

The tank 2*a* of the X-ray generation device 2 described above is disposed generally in the center part inside the first case 3 as shown in FIG. 1, and the tank cooling unit 2*b* of the X-ray generation device 2 is disposed on the front face side of the second case 4 as shown in FIG. 2. In other words, the X-ray generation device 2 is disposed inside both cases 3, 4 so as to penetrate a boundary wall 7 of both cases 3, 4 which is the top plate of the first case 3 or the bottom plate of the second case 4. The tank 2*a* of this X-ray generation device 2 is configured to store an X-ray source inside a container filled with oil for cooling. Also, the tank cooling unit 2*b* arranged on the upper surface of the tank 2*a* is formed of fins for heat radiation covered with a cover.

As shown in FIG. 2, the intake port 5 and the exhaust port 6 are arranged on the back face side of the second case 4. Also, the inside of the second case 4 is separated into two chambers of an intake chamber 8 including the intake port 5 and an exhaust chamber 9 including the exhaust port 6 by a wall body 10, and the tank cooling unit 2*b* described above is disposed so as to penetrate the wall body 10 and forms a part of a flow passage A (shown by an arrow in the drawing) of the air that flows from the intake chamber 8 to the exhaust chamber 9. Further, as described below, a radiation member 15*b* of a heat exchange device 15 and a fan F are disposed near the intake port 5 of the intake chamber 8 inside the second case 4, and a fan F is disposed near the exhaust port 6 of the exhaust chamber 9 inside the second case 4.

As shown in FIG. 1, the inside of the first case 3 is separated into plural chambers called cooling partitions C1 to C4 by the tank 2*a* of the X-ray generation device 2 disposed at the center part thereof and plural separation walls 16 properly disposed around the tank 2*a*, and respective devices which are the heat sources to be cooled or the heat exchange device 15 which is cooling means are stored within these respective cooling partitions C1 to C4. With respect to the plural heat sources existing inside the first case 3, as the index indicating the heat resistant property or the upper limit of the usable environmental temperature, the intrinsic use limit temperature is determined respectively. Also, as described below, the plural cooling partitions C2 to C4 where the heat sources are stored are separated for each use limit temperature of the heat source stored there. In other words, for each of the cooling partitions C2 to C4, the use limit temperature of the heat source stored there is determined.

First, as shown in FIG. 1 and FIG. 3, on the back face side of the inside of the first case 3, the first cooling partition C1 is arranged. This first cooling partition C1 is a heat absorption area, the heat source is not disposed here but a heat absorption member 15*a* of the heat exchange device 15 is disposed. This heat exchange device 15 is a device in which a heat conducting medium is sealed inside a hermetically sealed case, and the lower half thereof shown in FIG. 3 is the heat absorption member 15*a* provided with the heat absorption fins. As shown in FIG. 1, the fan F is provided in this heat absorption member 15*a*, and it is configured to suck the air present in the first cooling partition C1 to the heat absorption member 15*a* to allow passing through and to promote heat absorption by the fins.

Also, the upper half part of the heat exchange device 15 shown in FIG. 3 is the heat radiation member 15*b* provided with the heat radiation fins. As described above referring to FIG. 2, this heat radiation member 15*b* is disposed near the intake port 5 inside the intake chamber 8 of the second case 4 which is the heat radiation area. The fan F is arranged in the heat radiation member 15*b*, and it is configured to suck the external air to cool the heat radiation member 15*b*, and to supply the air to the tank cooling unit 2*b* described above to cool the X-ray generation device 2.

As shown in FIG. 1, at generally center part of the inside of the first case 3, the second cooling partition C2 is arranged. This second cooling partition C2 is a chamber having generally annular shape in a plan view configured by separating a part of the surrounding of the tank 2*a* disposed at generally center part by the separation wall 16. In relation with the direction of the flow passage of the air generated in the second cooling partition C2 by the fan F of the heat exchange device 15 (the flow of the air shown by an arrow B in the drawing), a PC 17 as a control unit is disposed on the front face side of the first case 3 which is on relatively upstream side, and a first electric supply unit 18 is disposed on the right side face side (the left side in FIG. 1) of the first case 3 which is on relatively downstream side. The PC 17 is a device for controlling respective parts of the X-ray inspection device 1, the first electric supply unit 18 is a device for supplying required electric supply to portions other than the X-ray generation device 2, and both are the heat sources requiring cooling. Also, the use limit temperature of the both is equally 60° C. The fan F is arranged for each of the PC 17 and the first electric supply unit 18, and it is configured to effect cooling by sucked air. Further, in the separation wall 16 that separates a first electric supply unit 18 and the first cooling partition C1 from each other, with the first electric supply unit 18 being positioned on the furthest downstream side with respect to the direction of a flow passage B of the air in the second cooling partition C2 and with the heat exchange device 15 existing in the first cooling partition C1, the fan F is penetratingly arranged, and it is configured that the air having cooled the first electric supply unit 18 and having been heated is returned to the first cooling partition C1.

As shown in FIG. 1, on relatively upstream side of the PC 17 with respect to the direction of the flow passage B of the air generated inside the second cooling partition C2 by the fan F of the heat exchange device 15, the third cooling partition C3 communicating by an opening formed in the separation wall 16 is arranged with predetermined independency from the second cooling partition C2. This third cooling partition C3 exists on the opposite side face of the device 1 with respect to the first electric supply unit 18 of the second cooling partition C2 and is disposed on left side face side (the right side in FIG. 1) of the first case 3, and a second electric supply unit 19 is arranged inside thereof. This second electric supply unit 19 is a device for supplying an electric supply required for driving the X-ray generation device 2, and is a heat source requiring cooling. Also, its use limit temperature is 50° C., and is lower than 60° C. which is the use limit temperature of the heat source of the second cooling partition C2. The second electric supply unit 19 is provided with a fan F, and is configured to be cooled by the sucked air. Further, the fan F is penetratingly arranged in the separation wall 16 that separates the third cooling partition C3 and the first cooling partition C1 where the heat exchange device 15 exists, and it is configured that the air having cooled the second electric supply unit 19 and having been heated is returned to the first cooling partition C1.

As shown in FIG. 1, at the position on relatively downstream side of the third cooling partition C3 with respect to the flow passage B of the air generated inside the second cooling partition C2 by the fan F of the heat exchange device 15 and is generally same position with the PC 17, the fourth cooling partition C4 separated against the second cooling partition C2 by the separation wall 16 is arranged with predetermined independency from the second cooling partition C2. This fourth cooling partition C4 is disposed on a further front face side of the first case 3 than the PC 17, and an LCD (liquid crystal display device) 20 is disposed inside thereof to allow visibility from the outside of the first case 3. The LCD 20 is obtained by adhering a touch panel, is a device used as a display device for displaying information and the like required at the time of operation of the X-ray generation device 2 or an input device in executing various operations, and is a heat source requiring cooling. Also, its use limit temperature is 50° C., and is lower than the use limit temperature 60° C. of the PC 17 and the first electric supply unit 18 which are the heat sources of the second cooling partition C2.

As shown in FIG. 1, although there is no fan F for exclusive use in the LCD 20 particularly, the air having flown through the second cooling partition C2 is divided into two routes before the PC 17, and one of them circulates through the LCD 20 of the fourth cooling partition C4, cools it, thereafter enters the first electric supply unit 18 of the second cooling partition C2 again, and returns to the first cooling partition C1. Also, the flow of the air flowing through the second cooling partition C2 and being headed for the PC 17 cools the PC 17, and thereafter returns to the first cooling partition C1 through a duct 21. In other words, the second cooling partition C2 in the vicinity of the PC 17 and the first cooling partition C1 are connected with each other by the duct 21, the fan F for drawing the air into the first cooling partition C1 is arranged at an opening of the duct 21 connected to the first cooling partition C1, and it is configured to return the air having cooled the PC 17 into the first cooling partition C1.

As shown in FIG. 1 and FIG. 3, inside the first cooling partition C1 inside the first case 3, an interference prevention plate 22 of the flow-in air is disposed in the vicinity of the heat absorption member 15*a* of the heat exchange device 15. Because of the disposal angle of the interference prevention plate 22, the air supplied by the fan F through the duct 21 hits one surface of this interference prevention plate 22 to change the direction, and is led to the heat absorption member 15*a*. Also, the air supplied by the fan F from the first electric supply unit 18 of the second cooling partition C2 hits the other surface of this interference prevention plate 22 to change the direction, and is led to the heat absorption member 15*a*. Thus, because the flows F, F of the air coming from these two fans F, F respectively hit the front face and the back face of the interference prevention plate 22, there is no possibility that these two flows collide on each other in the first cooling partition C1 where the heat absorption member 15*a* of the heat exchange device 15 is disposed. Therefore, two air flows B, B do not interfere with each other, are led smoothly to the heat absorption member 15*a* of the heat exchange device 15, and are heat-absorbed efficiently.

As shown in FIG. 3, in the lower part inside the first cooling partition C1 of the first case 3, an I/F unit 23 for external apparatuses is disposed. Also, below the first cooling partition C1 of the first case 3, a chamber D isolated from the first cooling partition C1 is arranged, and a fan F for cooling a heat source is arranged which is not illustrated.

As means for cooling the heat sources inside the first case 3, the X-lay inspection device 1 described above uses not an air conditioner requiring energy but the heat exchange device 15 having simple structure. Therefore, there is a feature that the cost is inexpensive and the running cost is also low. Here, it is considered in general that, compared to an air conditioner requiring energy, mere heat exchange device 15 is inferior in the cooling capacity, however, according to the X-ray inspection device 1 of the embodiment secures sufficient cooling capacity, no trouble occurs practically. The reason is that the inside of the first case 3 is separated into plural cooling partitions C1 to C4 having different use limit temperature, among them, the cooling partitions C2 to C4 store the heat sources having the use limit temperature corresponding to the cooling partition, the flow passage B making the air circulate through respective cooling partitions C1 to C4 in a predetermined order is arranged, and it is configured that each heat source having different use limit temperature can be efficiently cooled.

In other words, between the third cooling partition C3 where the second electric supply unit 19 having low use limit temperature exists and the first cooling partition C1 where the heat absorption member 15*a* exists, it is configured that the air directly circulates, whereas with respect to the fourth cooling partition C4 where the LCD 20 having low use limit temperature exists, it is configured that the air from the first cooling partition C1 where the heat absorption member 15*a* exists is made to directly flow in before cooling other heat sources, the air after cooling is made to flow through the second cooling partition C2 where the first electric supply unit 18 having higher use limit temperature exists, and is used for cooling. Also, with respect to the PC 17 that is positioned inner than the LCD 20 and is disposed so as to be hardly cooled, consideration is given so that a large portion of the air immediately after cooling the PC 17 is sucked to the first cooling partition C1 directly by the duct 21 and the fan F and that cooling by the PC 17 can be effected more efficiently.

Thus, inside the first case 3, a flow passage is formed which is for making the air circulate through the inside of the first case 3 as described below.

1) The air is made to circulate between the cooling partition C3 whose use limit temperature is low and the cooling partition C1 where the heat exchange device 15 exists, and the second electric supply unit 19 is cooled.

2) The air is made to circulate consecutively through the PC 17 and the first electric supply unit 18 existing inside the same cooling partition C2 and having equal use limit temperature to effect cooling, and is made to recirculate thereafter to the first cooling partition C1 where the heat exchange device 15 exists.

3) The air from the first cooling partition C1 where the heat exchange device 15 exists is made to circulate through the cooling partition C4 where the LCD 20 having low use limit temperature exists before the heat sources having high use limit temperature, is made to flow thereafter through the cooling partition C2 where the first electric supply unit 18 having high use limit temperature exists, and effects cooling consecutively.

Therefore, at the time of using the X-ray inspection device 1, plural heat sources inside the first case 3 are cooled efficiently by the air flowing along the flow passage B which is set between the cooling partitions based on the use limit temperature, and the heat thereof is efficiently absorbed by the heat absorption member 15*a* of the heat exchange device 15, is radiated from the heat radiation member 15*b* of the heat exchange device 15 disposed on the back face side of the inside of the second case 4, is added also with the heat from the tank cooling unit 2*b*, and is discharged along with the exhaust air to the environmental atmosphere from the exhaust port 16 for heat radiation arranged on the back face side of the second case 4.

Also, the heat exchange device 15 is arranged so as to penetrate the boundary of the first case 3 and the second case 4, and has a structure that the heat radiation member 15*b* protrudes from the outer surface of the first case 3. However, because the heat radiation member 15*b* of the heat exchange device 15 protruded from the outer surface of the first case 3 is arranged integrally with the first case 3 and is stored in the second case 4 which is opened to the environmental atmosphere, particular unevenness is not generated in the outer shape as the total of the first and second cases 3, 4. Therefore, the cases 3, 4 of the X-ray inspection device 1 are easy to clean and are excellent in the sanitary property.

An air conditioner includes a compressor driven by electric power, and utilizes a refrigerant that absorbs heat from the low temperature section and radiates the heat to the high temperature section by imparting work from the outside. According to the present invention, the heat exchange medium described above is different from the refrigerant, receives heat at the section having relatively high temperature, and conducts the heat to the section having relatively low temperature for radiation.

REFERENCE SIGNS LIST

1 . . . X-ray inspection device
3 . . . First case
4 . . . Second case
5 . . . Intake port
6 . . . Exhaust port
15 . . . Heat exchange device
15*a* . . . Heat absorption member
15*b* . . . Heat radiation member
16 . . . Separation wall separating cooling partitions
17 . . . PC as heat source
18 . . . First electric supply unit as heat source
19 . . . Second electric supply unit as heat source
20 . . . LCD as heat source
B . . . Flow passage
C1 to C4 . . . Cooling partition
F . . . Fan

What is claimed is:

1. An X-ray inspection device that inspects an object to be inspected by detecting X-rays irradiated to and transmitted through the object to be inspected, comprising:

a first case that is closed against an environmental atmosphere;

an X-ray generating device that generates heat and is disposed inside the first case;

electric supply units that generate heat and are disposed inside the first case;

a second case that is attached to the first case and is opened to the environmental atmosphere, the second case being configured not to communicate through air with the first case; and a heat exchange device for cooling the X-ray generating device and the electric supply units, the heat exchange device including a hermetically closed case and a heat exchange medium, the hermetically closed case having a heat absorption member disposed inside the first case and a heat radiation member disposed inside the second case, the heat exchange medium being sealed inside the hermetically closed case and conducting heat from the heat absorption member to the heat radiation member without being imparted with work from the outside.

2. The X-ray inspection device according to claim 1, wherein the first case stores heat sources including the X-ray generating device and the electric supply units, and a flow passage for cooling the heat sources by making air circulate in a predetermined order is formed inside the first case.

3. The X-ray inspection device according to claim 2, wherein a plurality of cooling partitions which is separated based on use limit temperature of the heat sources and stores the heat sources of the use limit temperature is arranged inside the first case, and the flow passage is set inside the cooling partitions so that the heat sources in which the use limit temperature is low are disposed upstream of the heat sources in which the use limit temperature is high.

4. The X-ray inspection device according to claim 1, wherein the electric supply units include first and second electric supply units arranged inside the first case at opposite sides to each other with respect to the X-ray generating device, and the second case is arranged above the first case.

5. The X-ray inspection device according to claim 1, wherein the second case is attached to an outer surface of the first case.

6. An X-ray inspection device that inspects an object to be inspected by detecting X-rays irradiated to and transmitted through the object to be inspected, comprising:

a first case that stores a plurality of heat sources inside and is closed against an environmental atmosphere;

a second case that is attached to the first case and is opened to the environmental atmosphere; and a heat exchange device for cooling the heat sources, the heat exchange device including a hermetically closed case and a heat exchange medium, the hermetically closed case having a heat absorption member disposed inside the first case and a heat radiation member disposed inside the second case, the heat exchange medium being sealed inside the hermetically closed case and conducting heat from the heat absorption member to the heat radiation member without being imparted with work from the outside, wherein inside the first case, an X-ray generating device is disposed at a center part of the first case, an LCD and a control unit as the heat source are disposed on a front face side of the first case, electric supply units as the heat source are disposed on side face sides of the first case, and the heat absorption member of the heat exchange device is disposed on a back face side of the first case, inside the second case, the heat radiation member of the heat exchange device is disposed on a back surface side of the second case, and the heat radiation member opposes an exhaust port formed on the back surface side of the second case.

7. The X-ray inspection device according to claim 6, wherein an interference prevention plate in which air introduced to the heat absorption member along the flow passage after cooling the control unit collides on one surface and air introduced to the heat absorption member along the flow passage after cooling the electric supply unit collides on another surface is arranged inside the first case.

* * * * *